US006591586B1

(12) United States Patent
Pape

(10) Patent No.: US 6,591,586 B1
(45) Date of Patent: Jul. 15, 2003

(54) METHOD AND A SYSTEM FOR FILLING GOODS IN BAGS FROM A COHERENT SERIES OF BAG MEMBERS

(75) Inventor: Henrik Pape, Horsens (DK)

(73) Assignee: Schur Packaging Systems A/S, Horsens (DK)

( * ) Notice: Subject to any disclaimer, the term of this patent is extended or adjusted under 35 U.S.C. 154(b) by 0 days.

(21) Appl. No.: 09/647,928

(22) PCT Filed: Apr. 21, 1999

(86) PCT No.: PCT/DK99/00219

§ 371 (c)(1),
(2), (4) Date: Oct. 16, 2000

(87) PCT Pub. No.: WO99/57017

PCT Pub. Date: Nov. 11, 1999

(30) Foreign Application Priority Data

Apr. 21, 1998 (DK) ..... 1998 00548

(51) Int. Cl.[7] ..... B65B 43/26

(52) U.S. Cl. ..... 53/459; 53/457; 53/381.2; 53/384.1

(58) Field of Search ..... 53/455, 457, 459, 53/381.2, 384.1

(56) References Cited

U.S. PATENT DOCUMENTS

| | | | | | |
|---|---|---|---|---|---|
| 3,599,388 | A | * | 8/1971 | Feingold | 53/459 |
| 3,699,746 | A | * | 10/1972 | Titchenal et al. | 53/384.1 |
| 3,733,770 | A | * | 5/1973 | Erickson et al. | 53/457 |
| 3,744,211 | A | * | 7/1973 | Titchenal et al. | 53/384.1 |
| 3,779,449 | A | | 12/1973 | Membrino | |
| 3,817,017 | A | | 6/1974 | Titchenal | |
| 3,967,776 | A | * | 7/1976 | Getsch et al. | 229/69 |
| 4,774,797 | A | * | 10/1988 | Colamussi et al. | 53/459 |
| 4,819,406 | A | * | 4/1989 | Redmond | 53/51 |
| 4,863,285 | A | | 9/1989 | Claxton | |
| 5,210,993 | A | * | 5/1993 | van Boxtel | 53/459 |
| 5,327,704 | A | * | 7/1994 | Hoekzema et al. | 53/459 |
| 5,357,733 | A | * | 10/1994 | Weikert | 53/455 |
| 6,050,061 | A | * | 4/2000 | Todd et al. | 53/455 |

FOREIGN PATENT DOCUMENTS

| | | |
|---|---|---|
| EP | 0 396 838 A1 | 11/1990 |
| EP | 0 555 321 B1 | 8/1993 |
| EP | 0 825 116 A1 | 2/1998 |

* cited by examiner

*Primary Examiner*—John Sipos
*Assistant Examiner*—Louis Huynh
(74) *Attorney, Agent, or Firm*—Nixon Peabody LLP; David S. Safran

(57) ABSTRACT

In connection with the packaging of items or loose material in sheet packings it is known to use a web of cohering flat bag members, which is successively conveyed to a filling station, in which the bag members are opened, one by one, for filling and subsequent closing and separation from the web. The free mouth edges of the bag members or the web are profiled for supported conveyance on opposed carrier rods, tubes or gripping chains which, just before the filling station, diverge from each other for effecting opening of the bag members. The invention provides for a flat bag web, the upright edge strip portions of which are caused to be folded down over respective opposed carrier chains. These strip portions are prepared with a row of perforations which, by the down-folding, are moved down into holding contact with holding pins upwardly projecting from the carrier chains, whereby a very safe carrying and conveying engagement is obtained without any special profilation of the mouth edges and with a simple design of the carrier chains.

3 Claims, 1 Drawing Sheet

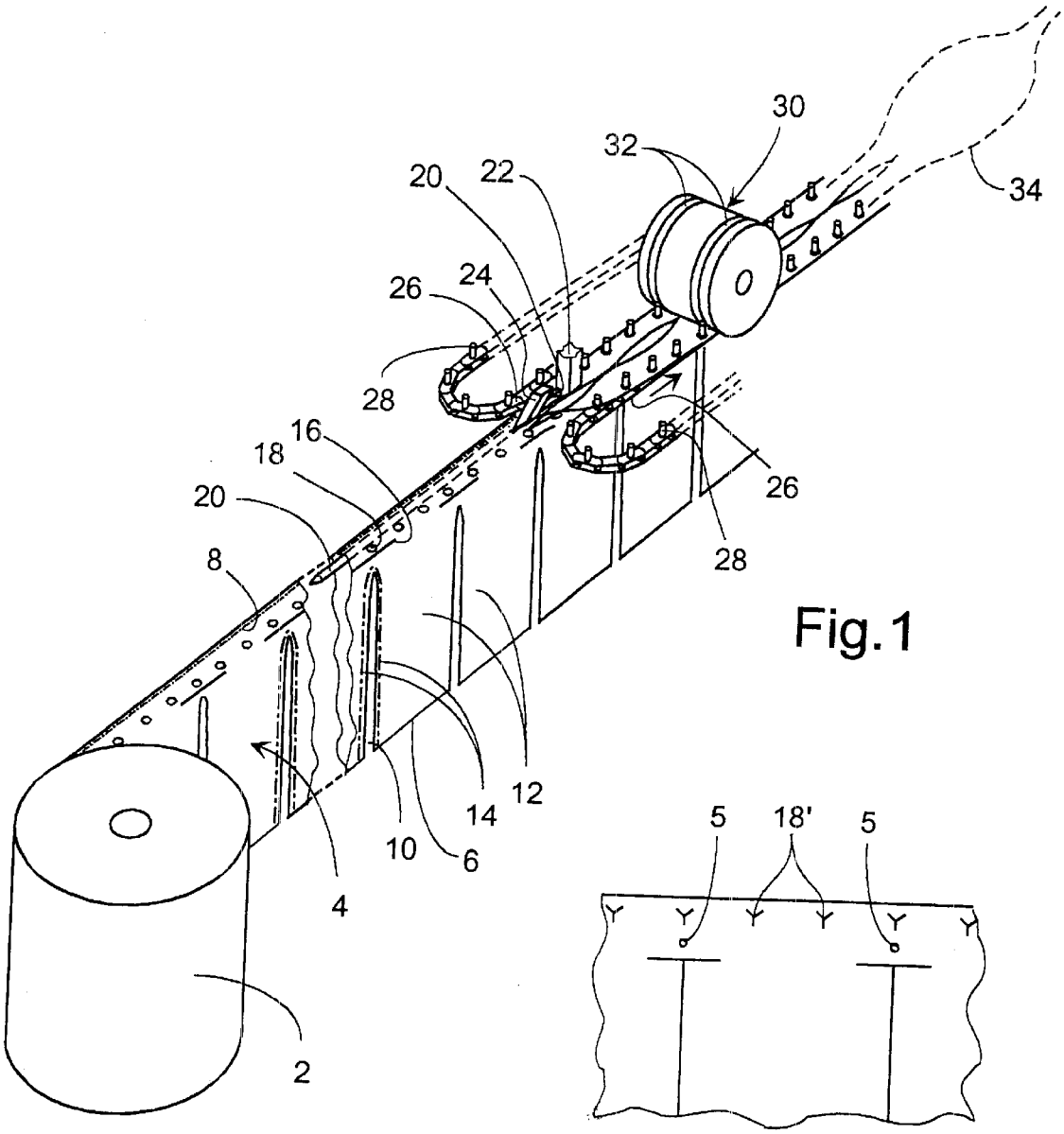
Fig.1
Fig.2
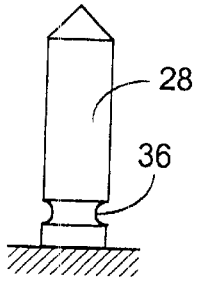
Fig.3

METHOD AND A SYSTEM FOR FILLING GOODS IN BAGS FROM A COHERENT SERIES OF BAG MEMBERS

BACKGROUND OF THE INVENTION

1. Field of the Invention

The present invention concerns a method and a system for the packing of items in bags of foil, which in a coherent web are fed through a filling station in which a filling of the individual bags is effected, and which are then closed and separated from the coherent web in the formation of individual packages.

2. Description of Related Art

A basic example of this technology is described in EP-696997, where it is disclosed that the opposing upper edge areas of the bag web are provided with bent-over channel—forming edge parts for drawing in on carrier rods, which in the feeding direction have a mutual enlargement to bring about an opening of the bags, so that these can be filled, e.g. through an overlying filling funnel, after which the carrier rods are again drawn in towards one another for provisional closing of the filled bags. The bags can then finally be closed by being welding together down under the said channel part, after which they are cut over and mutually separated. It is disclosed as an alternative that instead of the channel parts, use can be made of thickened edges which can be introduced into slotted carrier tubes for a quite corresponding feeding forwards of the bags.

There have since been suggested other forms of means used for the gripping and supporting of the opposing upper edges of the bag web, e.g. as disclosed in EP 0 555 31 B, where use is made of special gripping chains for this purpose, without any special requirements concerning the configuration of the upper edge areas of the folded bags. This is of particular importance, in that as starting point a simple, rolled-up web of flat foil without local thickenings can be used, but on the other hand there are considerable problems both with regard to the control of the opposing bag edges for secure engagement with the gripping chains and with regard to a desirable inexpensive configuration of these chains.

Moreover, in EP 0 825 116 it is disclosed that operations can be carried out with a closed, flat tubular web of foil, which can be continuously cut up along its upper edge, with associated integrated folding out and gripping of the upper edges thus cut up, without these being specially configured either as channels or with thickenings, which constitutes a distinct simplification of the requirements concerning the formation of the bag web. The cut-up upper edge parts are folded out for clamping between respectively moved belts which are provided with longitudinal depressions and corresponding pressing-in strings, whereby a suitably firm support engagement can be established.

However, this engagement is no more firm than axial slipping can occur between the upper edges of the bag web and the associated belt conveyor means, whereby uncertainty can arise concerning the degree to which an item being fed has been fed forward with the conveyor belts in a fully synchronous manner. Moreover, deviations can arise with regard to the height at which that area of the web sides which are clamped between the conveyor belts lies, which can be of significance with regard to whether the filled bags are finally closed at precisely the place at which the closure is intended, e.g. seen in relation to printing on the bag.

SUMMARY OF THE INVENTION

With the present invention, it has been found possible to use the relevant cutting-up and folding-out of the upper edge areas in order to achieve a reliable and quite firm gripping of the edge areas, i.e. when these are provided beforehand with a simple row of small holes, and when in the folding-out and the hereto related pressing-down, care is taken that the pressing-down at least of the one side, but preferably at both sides, is effected in such a manner that these holes are placed down over upright holding pins on a feeding chain. In a simple manner, there can hereby be established a completely firm and well-defined support engagement without the bag being required to have any thickening at the upper edge, and without the carrier chains having to be configured in a complicated manner with special, controllable gripping means, in that they merely require to be provided with said upright holding pins. The formation of the edge holes can be effected in a quite simple manner, especially because the holes along the two upper edges areas can be formed in the same operation.

Correspondingly, the carrier chains can thus be moved freely through a sequence in which, in the filling station, they will draw the folded-out web edges out from each other in such a way that the bags are hereby opened for the filling with products from above or possibly from the side. Hereafter, the web edges can again be brought together with the view to the final closing and cutting-free of the filled bags. It will be without importance for the feeding accuracy whether a certain pull on the bag web arises during the feeding, in that this will safely be fed synchronously with the support chains.

The invention also comprises a bag filling machine and a packaging line configured for the execution of the method according to the invention.

BRIEF DESCRIPTION OF THE DRAWINGS

In the following, the invention will be explained in more detail with reference to the drawing, in which FIG. 1 is a schematic perspective view for the illustration of the invention, FIG. 2 is a plan view of a bag web according to the invention, and FIG. 3 is a side view of a holding pin used in the system according to FIG. 1.

DETAILED DESCRIPTION OF THE INVENTION

In FIG. 1 it is shown that a web of foil material 4 can be unwound from a supply roll 2, said web consisting of a double foil folded up around a bottom edge 6, and which along the upper edge is closed by a simple welding 8 without any bending-over or thickening of any kind. Therefore, this can also be said to be a tubular foil. In the web there are a number of slots 10 which extend from the bottom edge 6 up to a distance below the top edge 8, so that the web appears with mutually separated bags 12, the side edges of which are closed by welds 14. Just above the top of the slots 10, the double web is cut through at respective horizontal lines 16 which extend a short distance out to both sides of the related slots 10.

Between the top edge 8 and the cut lines 16, the edge portion of the web is broken through by a single row of perforated holes 18.

This forwardly-influence web 4, which instead of being rolled up can best appear in a supply box in zig-zag folded form, is unwound at a filling aggregate on a support rod or support rail 20 which extends from a fixed support part 22 of the aggregate and serves for the simple support of the closed top edge 8 of the web 4.

Slightly in front of the support part 22, the support rod 20 has an upwardly-extending knife element 24 which, when the web 4 is pulled forwards, will continuously cut up the upper edge of the web, and hereafter there is arranged a continuing support system consisting of opposing, parallel chain drives 26 which are provided with upright holding pins 28 for engagement with the holes 18 in the respective upper edge parts 4 laid out to both sides, and by a pressure roller 30 which after the threading-in of the foil web serves to press the said folded-out upper edge areas of the web 4 down against the fixed under-supported carrier chains 26 into horizontal contact against the upper sides of these, and hereby during the swinging-down of the holes 18 in such a manner that the holes 18 are swung down and engage over the chain pins 18. The pressure roller 30 is configured with annular grooves 32 to provide free passage for the outer end parts of the chain pins 28, and in these grooves there are bedded transverse pins (not shown) which in a gearwheel-like fashion can co-operate with the chain pins 28 for automatic, synchronous driving of the pressure roller 30.

Hereafter, the opposing upper edge parts of the web 4 will be firmly anchored to the support pins 28, and the carrier chains can thus be controlled forward through a desired sequence for successive opening of the bags as indicated at 34, and for the closing of the bags after they have been filled. It is not considered necessary to describe this in more detail. However, it should be noted that the pins 28 are disposed in the chains' neutral lines, so that the bag web is not exposed to stretching or slackening during passages with changes in direction.

With a closing of the bags by welding immediately below the top of the slots 10, and possibly a subsequent cutting-off, the filled bags are separated from the remaining part of the web which is rolled up as excess material.

It must be mentioned that on the fixed support part 22 it is preferred to place a guiding element with a double-bladed ploughshare shape which actively brings about or initiates the shown folding-out of the perforated edge areas of the web, whereby improved security can be achieved with regard to the essential function, which the controlling down of the holes over the pins 28 constitutes.

In FIG. 2 it is shown that instead of said holes 18, it can be preferred to use star-shaped perforations 18', in that in the formation of these there will not be any problems with regard to stamped-out small parts.

As indicated in FIG. 2, a spot-welding assembly 5 can be effected between the opposing web sides in the part areas in between the bags. The object of these assemblies, which can be pulled apart, is to demarcate an upper longitudinal channel for engagement over the support rod 20 and the stabilising of the web on this rod.

In FIG. 3 it is shown that the pins 28 can be pointed towards the top in order to ensure a more safe engagement in the star perforations 18', and also configured with a lower recess 36 which will serve to provide extra retention of the web edge area when this has first been brought completely down over the pin.

What is claimed is:

1. A method for the packaging of items or loose materials in foil bags comprising the steps of:

feeding vertically oriented, unfilled foil bags as a coherent web through a filling station in which a mouth of each bag is held open for filling with the items or materials;

filling the foil bags with the items or materials;

closing the filled foil bags;

separating the filled foil bags from the web, wherein a mouth edge of the unfilled foil bag web is brought into controlled connection with a feeding means comprising two horizontal, opposed carrier chains having freely upstanding pins arranged to secure and feed opposing bag mouth edges between the carrier chains along a path through a filling station by forcing the mouth edges of the unfilled foil bag away from each other and folding the mouth edges out from each other for successive folding down onto and securing to said feeding means for successive opening of the bags at the filling station and, after filling of the unfilled foil bags, bring the mouth edges of the filled foil bags together for the closing of the filled foil bags, and wherein the mouth edge of each vertically oriented, unfilled foil bag has a strip edge area provided with a series of holes or star perforations which are folded down and brought into holding engagement with the upstanding pins on the carrier chains by successively pressing the holes or star perforations down over said upstanding pins.

2. An apparatus for the packaging of items or loose materials in foil bags comprising a filling station for filling the foil bags with the items or materials, a separation means for separating the filled foil bags from a web of foil bags, the apparatus further comprising:

feeding means for feeding vertically oriented, unfilled foil bags as a coherent web through the filling station in which a mouth of each unfilled foil bag is held open for filling with the items or materials wherein a mouth edge of the unfilled foil bag web is brought into controlled connection with the feeding means, said feeding means comprising two horizontal opposed carrier chains having freely upstanding holding pins, said holding means being arranged to secure and feed opposing bag mouth edges between the carrier chains along a path through the filling station a folding means for forcing the mouth edges of the unfilled foil bag away from each other and folding the mouth edges out from each other, a pressure means positioned after said folding means for successive pressing down and securing the mouth edges to the carrier chains to enable successive opening of the bags at the filling station, and a closing means bringing the mouth edges of the filled foil bags together for the closing of the filled foil bags, and wherein the mouth edge of each vertically oriented, unfilled foil bag has a strip edge area provided with a series of holes or star perforations, wherein said folding means folds down said strip edge area and said pressure means brings said series of holes or star perforations into holding engagement with the upstanding holding pins on the opposed carrier chains by successively pressing the holes or star perforations down over said upstanding pins, and wherein the upstanding holding pins on the opposed carrier chains engage the respective opposed mouth edges of the bag web towards and through the filling station.

3. The apparatus according to claim 2, wherein the pressure means comprises a pressure roller which is configured with annular grooves which allow free passage of the upstanding holding pins.

* * * * *